United States Patent [19]

Jacobs et al.

[11] Patent Number: 4,721,883

[45] Date of Patent: Jan. 26, 1988

[54] ELECTROLUMINESCENT DISPLAY AND METHOD OF MAKING SAME

[76] Inventors: Sidney Jacobs, 2607 Mimi Circle, Philadelphia, Pa. 19131; John S. Peluso, 70 Lady Diana Circle, Marlton, N.J. 08053

[21] Appl. No.: 869,437

[22] Filed: Jun. 2, 1986

[51] Int. Cl.[4] ..... H05B 33/04; B05D 5/12

[52] U.S. Cl. ..... 313/505; 313/511; 427/66; 428/917

[58] Field of Search ..... 313/51, 498, 505, 506, 313/509, 511, 512; 445/23, 24, 25; 427/66; 428/917; 174/52 FP; 361/395, 398

[56] References Cited

U.S. PATENT DOCUMENTS

| | | | |
|---|---|---|---|
| 2,485,607 | 10/1949 | Kasperowicz | 117/33.5 |
| 2,729,583 | 1/1956 | Sadowsky | 154/95 |
| 2,734,013 | 2/1956 | Myers | 154/95 |
| 2,757,112 | 7/1956 | Hoyt | 154/99 |
| 2,945,976 | 7/1960 | Fridrich et al. | 313/108 |
| 3,177,391 | 4/1965 | Devol et al. | 313/108 |
| 3,212,959 | 10/1965 | Varadi et al. | 161/167 |
| 3,214,622 | 10/1965 | D'Errico et al. | 313/108 |
| 3,226,272 | 12/1965 | Longfellow | 156/67 |
| 3,252,845 | 5/1966 | Schindler et al. | 156/67 |
| 3,253,173 | 5/1966 | Levetan | 313/108 |
| 3,305,745 | 2/1967 | Clock et al. | 313/108 |
| 3,341,915 | 9/1967 | Knochel et al. | 29/25.11 |
| 3,341,916 | 9/1967 | Greene | 29/25.11 |
| 3,379,915 | 4/1968 | Sentementes et al. | 313/108 |
| 3,395,058 | 7/1968 | Kennedy | 156/67 |
| 3,497,750 | 2/1970 | Knochel et al. | 313/108 |
| 4,035,686 | 7/1977 | Fleming | 313/503 |
| 4,104,555 | 8/1978 | Fleming | 313/512 |
| 4,238,793 | 12/1980 | Hochstrate | 340/781 |

OTHER PUBLICATIONS

"Recent Advances in Dicroic Liquid Crystal Display for Automotive Application", I Mecke E, 1981, pp. 331–336.

*Primary Examiner*—Leo H. Boudreau
*Assistant Examiner*—Sandra L. O'Shea
*Attorney, Agent, or Firm*—Ratner & Prestia

[57] ABSTRACT

An electroluminescent display is fabricated from an electroluminescent panel having an electroluminescent material coated on a substrate and a transparent conductor covering the electroluminescent material. Conductors, disposed on opposite sides of the electroluminescent material, and leads to the conductors which supply electricity to the conductors to excite the electroluminescent material are coated as unitary members on the electroluminescent panel and an adjacent non-conducting carrier strip attached to an edge of the electroluminescent panel.

9 Claims, 6 Drawing Figures

ELECTROLUMINESCENT DISPLAY AND METHOD OF MAKING SAME

TECHNICAL FIELD

The present invention relates, in general, to electroluminescent devices and, in particular, to (1) a method for applying the conductors and leads through which electricity is supplied to excite the electroluminescent material, and (2) the product made by this method.

BACKGROUND ART

In the past, electroluminescent displays were fabricated by carefully depositing electroluminescent material layers of prescribed thicknesses at designated locations on a substrate and selectively placing electrical conductors, which carry electricity to excite the electroluminescent material, on both sides of the electroluminescent material. These displays presented little risk to short-circuiting the electrical conductors when electrical leads, through which power is supplied, were mechanically fastened to their respective electrical conductors. The designer of the electroluminescent display had sufficient flexibility in shaping, sizing and positioning the electrical conductors and their associated electrical leads, so that they would not overlap at the connection points and create a short-circuit as connections were made and the connecting components might pierce through the display.

Recently, electroluminescent sheets and rolls have become available and have received widespread acceptance. Typically, electroluminescent sheets and rolls are relatively thin and are composed of a substrate coated with the electroluminescent material and a transparent conductor covering the electroluminescent material. Panels of desired size and shape are cut from the electroluminescent sheet or roll and then selectively coated with conductors, so that selected segments of the electroluminescent material are excited to produce the desired display when the conductors are energized.

It is apparent that producers of electroluminescent displays, when using electroluminescent sheets and rolls, are spared the problem of handling electroluminescent material and depositing this material cover accurately defined areas in layers of prescribed thicknesses. They have a simpler task of selectively applying conductors to a panel cut from an electroluminescent sheet or roll to selectively energize the electroluminescent material.

However, connecting the electrical leads, through which power is supplied to the electroluminescent panel, to conductors disposed on opposite sides of the electroluminescent material can be a costly and time-consuming step in the fabrication of these electroluminescent displays. Care must be taken to assure that the components, such as copper clips, which press the electrical leads into good electrical contact with their respective conductors do not penetrate the relatively thin panel and short-circuit the conductors through these components. The risk of a short-circuit exists because the transparent conductor, which is part of the electroluminescent sheet or roll, extends across the entire face of the panel. A connecting component, applied to a conductor on the opposite side of the panel from the transparent conductor, will make contact with the transparent conductor if it penetrates through the panel.

DISCLOSURE OF THE INVENTION

An electroluminescent display is fabricated, according to the present invention, by attaching a non-conducting carrier strip to an edge of an electroluminescent panel having an electroluminescent material on a first surface of a non-conducting substrate and a transparent conductor covering the electroluminescent material. Next, first and second unitary metallic conductors are applied to opposite surfaces of the electroluminescent panel/carrier strip unit. One unitary metallic conductor is composed of (1) a bus bar which is coated on the transparent conductor of the electroluminescent panel and (2) a first lead segment which is coated on an adjacent surface of the carrier strip and extends across the junction of the carrier strip and the electroluminescent panel to the bus bar. The second unitary metallic conductor is composed of (a) a plate which is coated on a second surface of the substrate of the electroluminescent panel and defines an area of excitation of the electroluminescent material and (b) a second lead segment which is coated on an adjacent surface of the carrier strip and extends across the junction of the carrier strip and the electroluminescent panel to the plate. The second lead segment is offset from the first lead segment in the plane of the carrier strip. Next, the coated electroluminescent panel/carrier strip unit is enclosed within a non-conducting envelope having a transparent surface extending across the transparent conductor and the bus bar. First and second terminals then are attached to the first and second lead segments, respectively.

BRIEF DESCRIPTION OF DRAWINGS

Referring to the drawings.

BEST MODE FOR CARRYING OUT THE INVENTION

Figure 1:
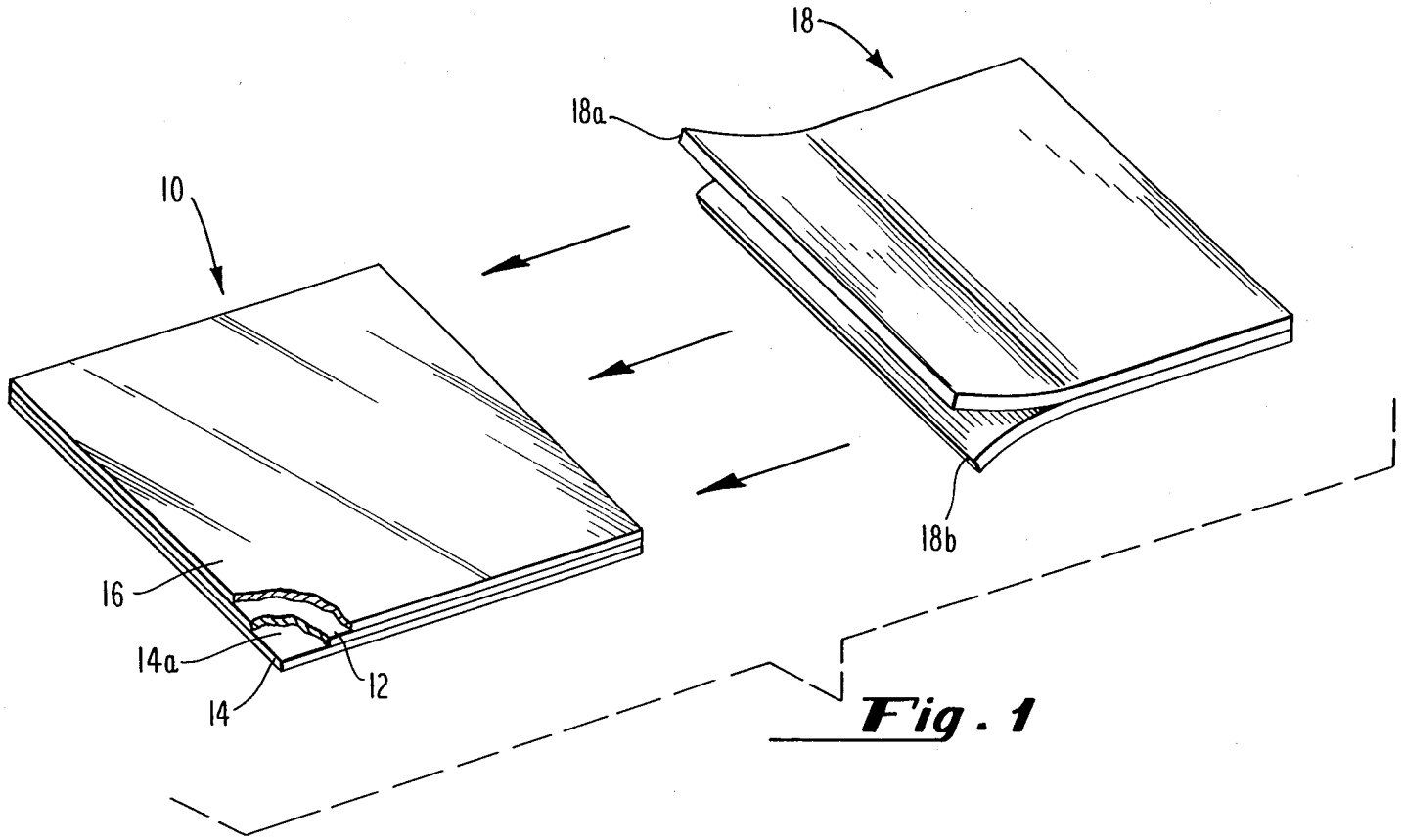
FIG. 1 is an exploded perspective view of the electroluminescent panel and carrier strip components of an electroluminescent display, constructed in accordance with the present invention, prior to the two components being joined together.

Referring to the drawings, an electroluminescent display, constructed in accordance with the present invention, includes an electroluminescent panel 10 having an electroluminescent material 12 on a first surface 14*a* of a non-conducting substrate 14 and a transparent conductor 16 covering the electroluminescent material. Electroluminescent panel 10 is cut to the desired shape and size from a relatively thin layered sheet or roll composed of the substrate, the electroluminescent material, and the transparent conductor. The electroluminescent coating can be any of a variety of phosphorescent materials, for example, a copper activated or copper manganese activated zinc sulfide. The substrate can be a polyester such as mylar. The transparent conductor can be indium tin oxide. FIG. 1 shows electroluminescent panel 10 at this stage in the fabrication of an electroluminescent display according to the present invention.

Next, a non-conducting carrier strip 18 is attached to an edge of electroluminescent panel 10. For the embodiment of the invention illustrated in the drawings, carrier strip 18 is composed of an upper part 18*a* and a lower part 18*b* which are placed in contact with each other but spread apart at one end, so that upper part 18*a* can be brought into contact with transparent conductor 16 and lower part 18*b* can be brought into contact with a second surface 14*b* of substrate 14 opposite from surface 14*a*. Carrier strip 18 can be a mylar material and can be attached to electroluminescent panel 10 by a suitable pressure sensitive adhesive or by heat fusion. Although carrier strip 18 is shown as being composed of two parts, one such part may be sufficient in certain applications.

After carrier strip 18 is attached to electroluminescent panel 10, conductors, which electrically excite electroluminescent material 12, are applied to opposite surfaces of the electroluminescent panel/carrier strip unit. Specifically, a first unitary metallic conductor is coated on transparent conductor 16 and the top surface of carrier strip 18 adjacent the transparent conductor. The first unitary metallic conductor includes a bus bar 20 coated on transparent conductor 16 and a first lead segment 22 coated on the top surface of carrier strip 18 and extending across the junction of the carrier strip and the electroluminescent panel to the bus bar. The coating of bus bar 20 and first lead segment 22 can be done by conventional selective coating techniques, such as by a silk screen process, which involves masking the surface to be coated and applying a metal, such as silver, according to the mask.

A second unitary metallic conductor is coated on surface 14*b* of substrate 14 opposite from surface 14*a* and on the bottom surface of carrier strip 18 adjacent surface 14*b* of the substrate. The second unitary metallic conductor includes a plate 24 coated on surface 14*b* of substrate 14 and a second lead segment 26 coated on the bottom surface of carrier strip 18 and extending across the junction of the carrier strip and the electroluminescent panel to plate 24. The second unitary metallic conductor can be applied in the same manner as is the first unitary metallic conductor.

Figure 2:
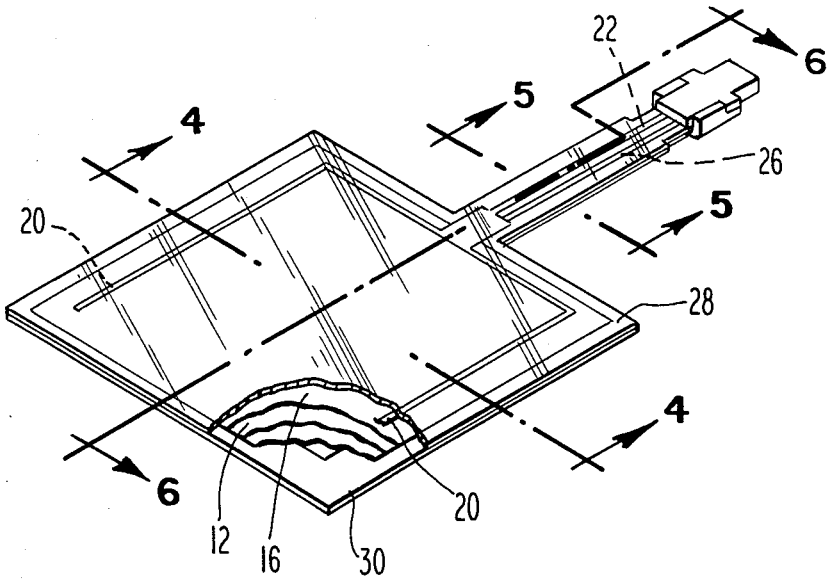
FIG. 2 is a top perspective view of an electroluminescent display constructed in accordance with the present invention.
Figure 3:
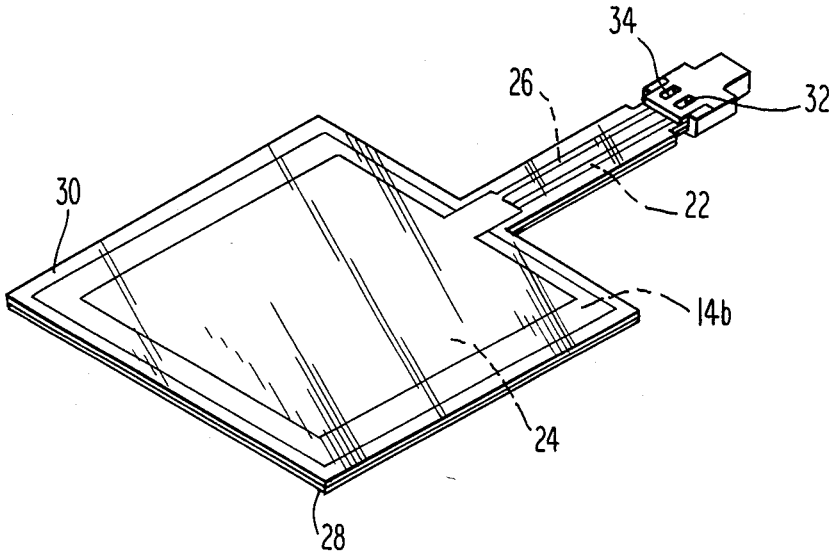
FIG. 3 is a bottom perspective view of the FIG. 2 electroluminescent display.
Figure 4:
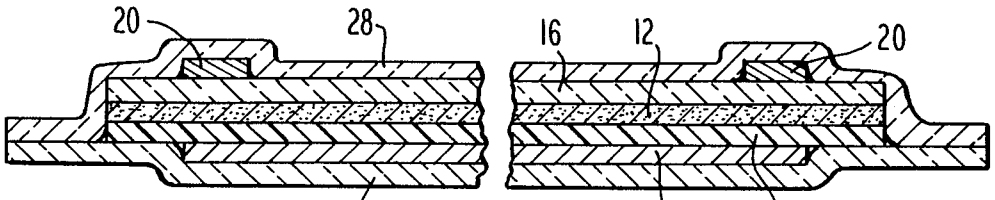
FIG. 4 is a sectional view, on an enlarged scale, taken along line 4—4 of FIG. 2.
Figure 5:
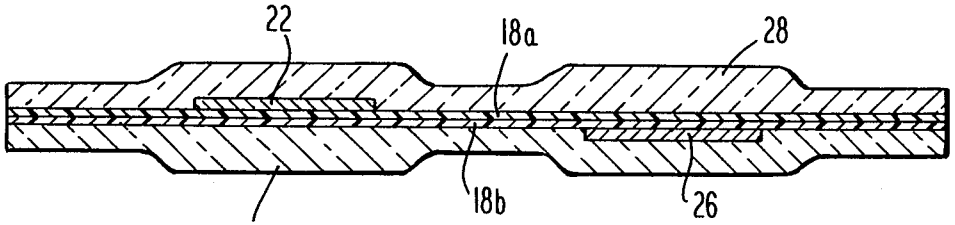
FIG. 5 is a sectional view, on an enlarged scale, taken along line 5—5 of FIG. 2.
Figure 6:
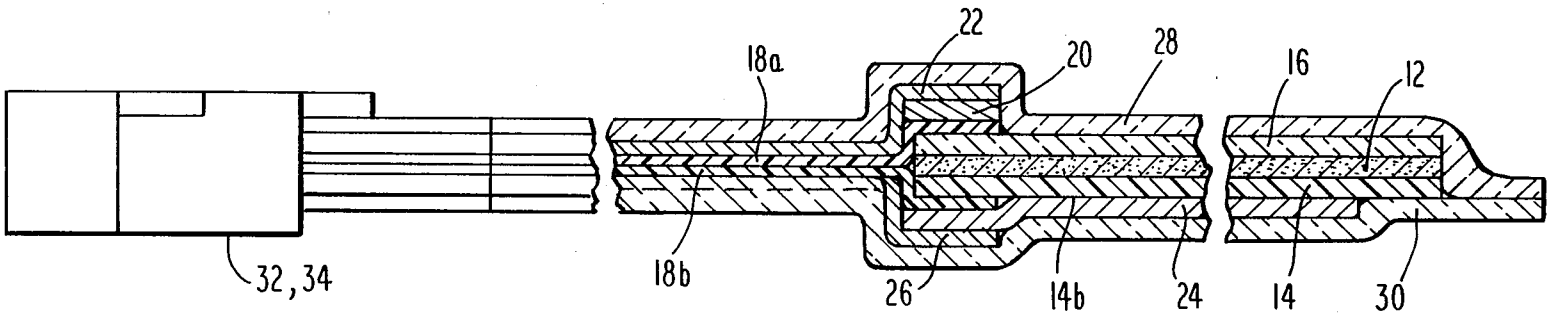
FIG. 6 is a sectional view, on an enlarged scale, taken along line 6—6 of FIG. 2.

Next, the electroluminescent panel/carrier strip unit is enclosed within a non-conducting envelope having a transparent surface extending over transparent conductor 16 and bus bar 20. This can be accomplished by placing a pair of transparent non-conducting sheets 28 and 30 on opposite sides of the unit with the edges of these sheets extending beyond the edges of the unit and heat-sealing the edges. Then the envelope is trimmed to the desired shape and size as shown in FIGS. 2 and 3.

First and second terminals 32 and 34 then are attached to lead segments 22 and 26, respectively. The mechanical attachment of terminals 32 and 34 to lead segments 22 and 26 is accomplished without regard to penetration completely through the carrier strip because the two lead segments are offset with respect to one another in the plane of the carrier strip.

Bus bar 22 serves to conduct electricity to different sectors of transparent conductor 16. Plate 24 defines the area of excitation of electroluminescent material 12. It will be apparent that differently shaped and sized conductors may be used to excite the electroluminescent material. The particular unit shown in the drawings includes a rectalinear electroluminescent panel and a rectalinear plate 24 and serves as a background light source for a dial indicator. The entire area of electroluminescent material above plate 24 is illuminated when power is supplied to the plate and bus bar 20.

More than one unitary metallic conductor can be applied to the bottom surfaces of substrate 14 and carrier strip 18. In such a case, each of the unitary metallic conductors has a plate which defines an area of excitation of the electroluminescent material and these areas can be excited selectively by supplying electricity selectively to the associated terminals and electrical lead segments.

The foregoing has set forth an exemplary and preferred embodiment of the present invention. It will be understood, however, that various alternatives will occur to those of ordinary skill in the art without departure from the spirit and scope of the present invention.

What is claimed:

1. A method for making an electroluminescent display comprising the steps of:

providing an electroluminescent panel having an electroluminescent material on a first surface of a non-conducting substrate and a transparent conductor covering said electroluminescent material;

attaching a non-conducting carrier strip to an edge of said electroluminescent panel;

applying a first unitary metallic conductor to said transparent conductor and to a surface of said carrier strip adjacent said transparent conductor, said first unitary metallic conductor having:

(a) a bus bar on said transparent conductor, and (b) a first lead segment on said carrier strip extending across the junction of said carrier strip and said electroluminescent panel to said bus bar;

applying a second unitary metallic conductor to a second surface of said substrate opposite from said first surface and to a surface of said carrier strip adjacent said second surface of said substrate, said second unitary metallic conductor having:

(a) a plate on said second surface of said substrate defining an area of excitation of said electroluminescent material, and (b) a second lead segment on said carrier strip extending across the junction of said carrier strip and said electroluminescent panel to said plate, said second lead segment offset from said first lead segment in the plane of said carrier strip;

enclosing said electroluminescent panel, said carrier strip and said unitary metallic conductors within a non-conducting envelope having a transparent surface extending over said transparent conductor and said bus bar;

and attaching first and second terminals to said first and second lead segments, respectively.

2. A method according to claim 1 wherein said non-conducting carrier strip is attached to said electroluminescent panel by a pressure sensitive adhesive applied between said non-conducting carrier strip and said electroluminescent panel.

3. A method according to claim 1 wherein said non-conducting carrier strip is attached to said electroluminescent panel by heat fusion.

4. A method according to claim 2 wherein said first and second unitary metallic conductors are applied by coating said conductors on the respective surfaces.

5. A method according to claim 4 wherein said first and second unitary metallic conductors are coated on the respective surfaces by:

(a) masking the surfaces to be coated, and
(b) applying a metal coating to selected areas of said surfaces in accordance with said masking.

6. An electroluminescent display comprising:

an electroluminescent panel having an electroluminescent material on a first surface of a non-conducting substrate and a transparent conductor covering said electroluminescent material;

a non-conducting carrier strip attached to an edge of said electroluminescent panel;

a first unitary metallic conductor on said transparent conductor and on a surface of said carrier strip adjacent said transparent conductor, said first unitary metallic conductor having:

(a) a bus bar on said transparent conductor, and
(b) a first lead segment on said carrier strip extending across the junction of said carrier strip and said electroluminescent panel to said bus bar;

a second unitary metallic conductor on a second surface of said substrate opposite from said first surface and on a surface of said carrier strip adjacent said second surface of said substrate, said second unitary metallic conductor having:

(a) a plate on said second surface of said substrate defining an area of excitation of said electroluminescent material, and
(b) a second lead segment on said carrier strip extending across the junction of said carrier strip and said electroluminescent panel to said plate, said second lead segment offset from said first lead segment in the plane of said carrier strip;

a non-conducting envelope enclosing said electroluminescent panel, said carrier strip and said unitary metallic conductors and having a transparent surface extending over said transparent conductor and said bus bar;

and first and second terminals attached to said first and second lead segments, respectively.

7. An electroluminescent display according to claim 6 wherein said non-conducting carrier strip includes upper and lower parts placed in contact with each other and spread apart at one end with said upper part in contact with said transparent conductor and said lower part in contact with said second surface of said substrate.

8. An electroluminescent display according to claim 7 wherein said first and second unitary metallic conductors are silver.

9. An electroluminescent display according to claim 6 wherein said electroluminescent panel is rectalinear said plate is rectalinear.

* * * * *